United States Patent [19]

Shapiro

[11] Patent Number: 4,648,721

[45] Date of Patent: Mar. 10, 1987

[54] QUICKLY RESETTABLE TIMER

[76] Inventor: Edward Shapiro, 421 Clair Dr., Upper St. Clair, Pa. 15241

[21] Appl. No.: 747,857

[22] Filed: Jun. 24, 1985

[51] Int. Cl.[4] ..... G04F 1/04

[52] U.S. Cl. ..... 368/93

[58] Field of Search ..... 368/93, 94, 95; D10/44

[56] References Cited

U.S. PATENT DOCUMENTS 2,149,404 3/1939 Pennington ..... 368/93

*Primary Examiner*—Bernard Roskoski

*Attorney, Agent, or Firm*—Webb, Burden, Robinson & Webb

[57] ABSTRACT

A quickly resettable timer is claimed which comprises a container having a base end and a reset end; a quantity of a flowing, particulate solid medium; a funnel-like receptacle having a loading orifice nearest the reset end and a metered orifice nearest the base end, the receptacle being mounted to and spaced from the interior wall sections of the container such that the particulate medium in the base end will flow over and around the receptacle and into the reset end upon inversion of the timer by rotation in any direction; and a ring fitted snugly against each interior wall section of the container intermediate the receptacle and the reset end, the ring having an aperture positioned above and sized smaller than the loading orifice of the receptacle. Preferably, the ring has inwardly protruding sides which taper toward each other to define the aperture. Most preferably, the receptacle and at least a portion of the container are made from a substantially transparent material.

15 Claims, 5 Drawing Figures

QUICKLY RESETTABLE TIMER

BACKGROUND OF THE INVENTION

1. Field of the Invention

This invention relates to timing devices. Particularly, the invention relates to a timer having a metered orifice through which a solid particulate medium flows for measurement of a time interval.

2. Description of the Prior Art

Hour glasses and timing devices which employ a quantity of a flowing, solid particulate medium have been known for centuries. Typically, these timers are constructed to have a particulate medium flow from a first chamber, through a metered orifice and into a second chamber. Once all of the particulate medium flows into the second chamber, the measurement of a time interval has been completed.

The particulate medium employed by such timers is pulled through the metered orifice from one chamber to the other because of the influence of gravity. The rates of flow within such timers are determined jointly by the size of the orifice between the chambers and by the nature of the particulate medium employed.

When the measurement of a time interval has been completed, most timers of this sort are typically inverted to start the flow of the particulate medium in the opposite direction. For the measurement of a second time interval, the particulate medium flows from the second chamber, through the metered orifice and back into the first chamber.

A difficulty with timers of this sort is that the particular time interval must be completed before restarting another by inversion. For an accurate measurement of a subsequent time interval, all of the particulate medium must flow through the metered orifice and into one of the aforementioned chambers. There is no easy way to quickly reset these timers.

It is known in the art that the metered orifice to such timers can be modified with moving parts for minimizing time loss due to resetting. For example, in U.S. Pat. No. 3,125,849, the timer was provided with a valved orifice which could be rotatably switched to one of several positions. In a first position, the particulate medium could flow from a first chamber through the timing orifice and into a second chamber for measurement of a time interval. In a second position, the setting position, the particulate medium could flow through a larger orifice at a more rapid pace. Because of quicker flow through this second orifice, less time was lost to resetting of the timer. Lastly, in a third position, the two chambers of this timer were completely separated to stop the flow of the particulate medium therebetween.

In a second, rapidly resettable timer, the two chambers were separated by a cup-shaped valve having a metered orifice or vent in the middle of one end. Exemplary of such a device is U.S. Pat. No. 2,144,857. The valve was attached to the base of one of the two chambers by a movable valve seat. When the valve was in its first position with the timer righted, a flowing medium passed through the vent and into a lower chamber for the measurement of a timing interval. When this timer was )inverted, the valve was pulled downward by gravity to open two (2) return passages for the flow of the particulate medium back to the original chamber.

Both of the aforementioned timers required some sort of moving part. Additionally, both devices required that the particulate medium flow through at least one and preferably two orifices for resetting. Though the sizes of these orifices were larger than their respective metered orifices, time was still lost to the flow of the particulate medium through these passageways during the reset stage for each timer.

In U.S. Pat. No. 4,408,894, a resettable timer was disclosed which did not employ some sort of moving part. The timer therein was resettable for selected time intervals depending upon the amount of particulate medium that was loaded into a measuring chamber. However, the resetting or loading of this timer required rotation of the device in a specific, selected direction. The only way to load the particulate medium was by a clockwise rotation of this timer.

SUMMARY OF THE INVENTION

A timer according to this invention comprises a container which defines a chamber having a base end and a reset end opposite the base end. A quantity of a flowing, solid particulate medium is contained within the chamber for the measurement of a time interval. The timer includes a funnel-like receptacle having a loading orifice nearest the reset end and a metered orifice nearest the base end for restricting flow of the particulate medium through the receptacle. This receptacle is mounted to and spaced from an interior wall section of the container intermediate the base end and the reset end such that the particulate medium in the base end can flow over and around the receptacle and into the reset end upon inversion of the container by rotation in any direction. Lastly, this timer includes a means for channeling the particulate medium from the reset end of the chamber, through the loading orifice and into the receptacle upon the righting of the container in any direction. The channeling means of the invention preferably comprises a substantially continuous ring positioned to fit snugly against each of the interior wall sections of the container intermediate the receptacle and the reset end of the chamber. The ring has an aperture positioned above and sized smaller than the loading orifice of the receptacle. Most preferably, the ring has inwardly protruding sides which taper towards each other to define the aperture. This shape allows for unrestricted flow of the particulate medium both into and out of the reset end of the chamber upon inversion and righting of the container.

The timer according to this invention does not contain any moveable parts. It is less susceptible to disablement caused by the flow of particulate medium around and about moveable parts. Additionally, the timer does not contain a restricted orifice through which the particulate medium must flow prior to resetting the timer. Rather, the loading orifice of this timer is of a sufficient dimension to allow unrestricted flow of the particulate medium into the receptacle. Since the timer of this invention does not contain specific, lengthy passageways through which the particulate medium must flow for entry into the receptacle, it can be quickly reset upon inversion and righting by rotation in any direction.

DETAILED DESCRIPTION OF THE PREFERRED EMBODIMENTS

Figure 1:
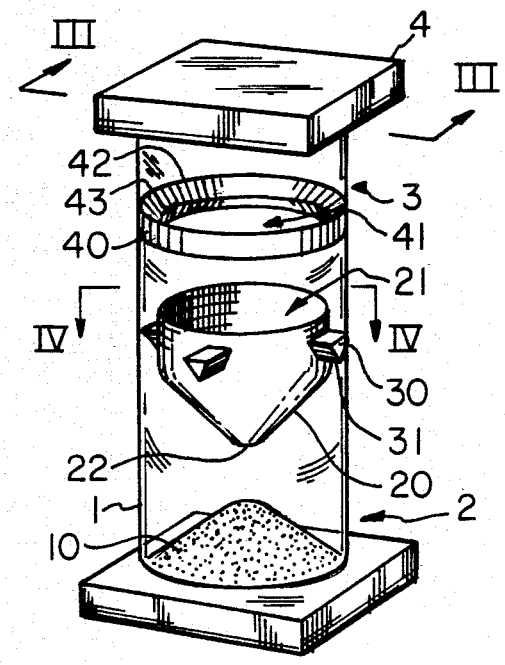
FIG. 1 is a perspective view of the quickly resettable timer.

This invention relates to a timer which can be quickly reset at any time during the measurement of a time interval. Quite simply, the timer is reset upon inversion and righting by rotation in any direction. As shown in the perspective and sectional views of a particular embodiment of the invention, FIG. 1 and FIG. 3, respectively, the timer comprises a container 1 which defines a chamber having a base end 2 and a reset end 3 opposite the base end. Preferably, the ends to the container 1 are protected and covered by a pair of container supports 4 mounted to each end.

A portion of the wall sections to the container 1, nearest the base end 2, must be constructed of a material which is substantially transparent. This allows operators of the timer to see when the measurement of a time interval has been completed. Most preferably, all wall sections which comprise the container 1 are constructed of a well known transparent plastic or glass.

A quantity of a flowing, particulate solid medium 10 is contained within the chamber defined by the container 1. This medium is comprised of sand or any other fine-grained powder which can flow readily under the influence of gravity through a metered orifice.

A funnel-like receptacle 20 is mounted to and spaced from the interior of the wall sections which comprise the container 1. In the preferred embodiment, the receptacle is likewise constructed from a transparent material. This receptacle 20 has a loading orifice 21 nearest the reset end and a metered orifice 22 nearest the base end of the chamber. The metered orifice 22 is used to restrict the flow of the particulate medium 10 through the receptacle 20 for the measurement of a time interval. In the invention, the receptacle 20 is mounted to the interior wall sections of the container 1 by at least one, and preferably four, supports 30. As shown in FIG. 1, the supports 30 are triangularly-shaped with an apex 31 of the triangle directed toward the base end 2 of the chamber. The function behind the shape of these supports 30 is to enable the particulate medium 10 in the base end 2 to flow over and around the receptacle 20 and into the reset end 3 upon inversion of the container 1 by rotation in any direction. None of the particulate medium should be retained when flowing over these supports 30.

Figure 3:
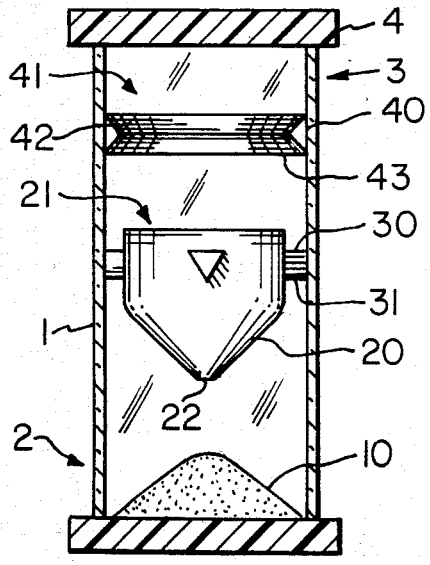
FIG. 3 is a section of FIG. 1 taken along lines III—III.

As shown in FIGS. 1 and 3, a substantially continuous ring 40 is positioned intermediate the receptacle 20 and the reset end 3 of the chamber. The ring 40 must fit snugly against a surface to each of the interior wall sections which comprise the container 1. The ring 40 constitutes the means for channeling the particulate medium 10 from the reset end 3 of the chamber, through the loading orifice 21 and into the receptacle 20 upon the righting of the container by rotation in any direction. For this purpose, the ring 40 has an aperture 41 positioned above and sized smaller than the loading orifice 21 of the receptacle 20. To further facilitate the flow of the particulate medium 10 into the reset end 3 upon inversion of the container 1, the ring 40 is comprised of an inwardly protruding upper side 42 and lower side 43 which taper toward each other to define the aperture 41. The combination of the sides gives the ring 40 a triangularly-shaped cross-section. Alternatively, the ring may have a cross-section shaped as a trapezoid. Either shape allows for flow of the particulate medium 10 both into and out of the reset end 3 upon inversion and righting of the container 1.

Figure 4:
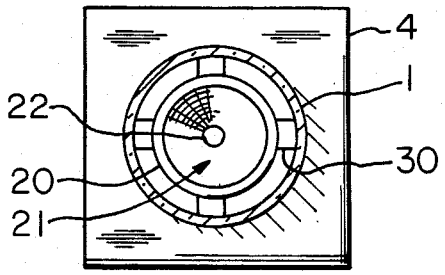
FIG. 4 is a section of FIG. 1 taken along lines IV—IV.

In the embodiment of the invention shown in FIG. 1, FIG. 3 and FIG. 4, the container 1 is shaped as a circular cylinder. Therein, the ring 40 has a diameter less than the diameter of the container 1 with the aperture 41 of the ring 40 having a diameter smaller than the diameter of the circularly-shaped loading orifice 21 of the receptacle 20.

Figure 2:
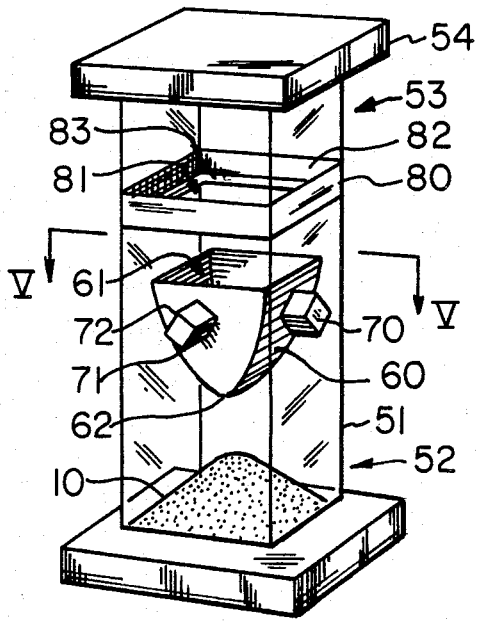
FIG. 2 is a perspective view of an alternative embodiment.
Figure 5:
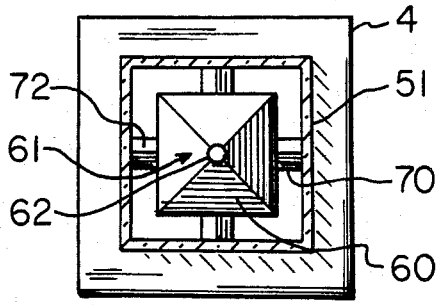
FIG. 5 is a section of FIG. 2 taken along lines V—V.

An alternative embodiment of the invention is shown in FIG. 2 and FIG. 5. In these views, the container 51 is shaped as an elongated, rectangular cylinder. The wall sections comprising the container 51 define a rectangular chamber having a base end 52 and a reset end 53 opposite the base end. As in FIG. 1 and FIG. 3, the ends to the container 51 of FIG. 2 are preferably mounted to a pair of container supports 54.

For the most part, the alternative embodiment operates in the same manner as the preferred mode shown in FIG. 1. The funnel-like receptacle 60 in FIG. 2 and FIG. 5 is depicted as correspondingly shaped to mount to and space from the interior wall sections of a container 51 having a rectangular cross-section. The receptacle 60 includes a rectangular loading orifice 61 nearest the reset end 53 and a metered orifice 62 nearest the base end 52. Preferably, the loading orifice 61 is opposite the metered orifice 62.

FIG. 2 also shows another means for mounting the receptacle 60 to the container 51. In this perspective view, preferably four (4) supports 70 attach the receptacle 60 to the interior wall sections. These supports 70 each have a diamond-shaped cross-section with a point 71 of the diamond directed towards the base end 52 of the chamber. The function behind this shape is to allow the particulate medium 10 in the base end 52 of the chamber to flow over and around the receptacle 60 and into the reset end 53 upon inversion in any direction. None of the particulate medium 10 should be retained when flowing over the diamond-shaped supports 70.

In the timer comprised of a rectangular cylinder, the channeling means, or substantially continuous ring 80, is appropriately modified in shape as shown in FIG. 2. This ring 80, likewise, has an aperture 81 positioned above and sized smaller than the loading orifice 61 of the receptacle 60. Furthermore, the ring 80 should be sized and dimensioned to fit snugly against each of the interior wall sections of the container 51 intermediate the receptacle 60 and the reset end 53 of the chamber. Preferably, the ring 80 has an inwardly protruding upper side 82 and lower side 83 which taper towards each other to define the aperture 81. The combinations of these sides gives the ring 80 a triangularly-shaped cross-section. Alternatively, the ring may be shaped as a trapezoid. Either shape allows for flow of the particulate medium 10 both into and out of the reset end 53 upon inversion and righting of the container 51.

FIG. 4 is a sectional view of the preferred embodiment of this invention, taken along lines IV—IV of FIG. 1. It shows the circularly-shaped cross-section of the container 1 atop the lower container support 4. Within this container, the funnel-like receptacle 20 is mounted. The receptacle 20 includes a loading orifice 21 and metered orifice 22 through which the particulate medium will flow for measurement of a time interval. As depicted in FIG. 4, the receptacle is mounted to and spaced equally from the interior wall sections which comprise the circular container 1. Specifically, the receptacle 20 is mounted by four (4) triangularly-shaped container supports 30, each having an apex, not shown, pointing toward the base end.

In FIG. 5, the corresponding view of the alternative embodiment of FIG. 2 taken along lines V—V, the receptacle 60 is mounted to and spaced from the interior wall sections of the rectangularly shaped container 51 by four (4) diamond-shaped supports 70. Each of these supports 70 has a point, not shown, directed toward the base end of the chamber. This point is opposite the other point 72 of the diamond and serves the aforementioned purpose. The receptacle 60 includes a rectangular loading orifice 61 nearest the reset end of the container 51. This loading orifice 61 funnels downward to the metered orifice 62 of the receptacle 60.

In a combination of the two previous embodiments (not shown), a circularly-shaped receptacle is fitted in a container whose cylinder has a square cross-section. Where the diameter of this loading orifice is sized smaller than the length of a side to the cylinder, the circularly-shaped receptacle can be attached directly to the interior wall sections at the four contact points without need of supports. In this combination of embodiments, the ring has a square perimeter for fitting snugly against each of the interior wall sections of the cylinder. However, the aperture extending through this ring is circularly-shaped and sized smaller than the loading orifice of the receptacle.

The operation of the invention is shown with respect to FIG. 1 and FIG. 3. Specifically, the particulate medium 10 contained within the chamber of the container 1 flows readily about the container 1. In order to reset the timer to measure an interval of time, the container 1 is inverted by rotation in any direction. This causes all of the particulate medium 10 in the base end 2 to flow over and about the receptacle 20 and receptacle supports 30, against the tapered lower side 43 of the ring 40 and into the reset end 3.

Upon righting of the container 1 by further rotation in any direction, the particulate medium 10 passes against the tapered upper side 42 of the ring 40, through the ring aperture 41 and the loading orifice 21, and into the funnel-like receptacle 20. Thereupon, the particulate medium 10 begins to immediately flow through the metered orifice 22 into the base end 2 for the measurement of a time interval.

Having presently described the particular embodiments of the invention, it is to be understood that changes and modifications may be made herein without departing from the spirit and scope of the appended claims.

I claim:

1. A quickly resettable timer which comprises:

a container defining a chamber having a base end and a reset end opposite the base end;

a quantity of a flowing, solid particulate medium container within the chamber;

a funnel-like receptacle having a loading orifice nearest the reset end and a metered orifice nearest the base end for restricting the flow of the particulate medium through the receptacle, said receptacle being mounted to and spaced from an interior wall section of the container intermediate the base end and the reset end such that the particulate medium in the base end flows over and around the receptacle and into the reset end upon inversion of the container by rotation in any direction; and means for channeling the particulate medium into the reset end of the chamber upon inversion and from the reset end of the chamber, through the loading orifice and into the receptacle upon righting of the container by rotation in any direction.

2. The timer of claim 1 wherein the channeling means comprises a substantially continuous ring having an outer periphery that fits snugly against each of the interior wall sections of the container intermediate the receptacle and the reset end of the chamber.

3. The timer of claim 2 wherein the ring has an aperture through which the particulate medium flows upon inversion and righting of the container, said aperture being positioned above and sized smaller than the loading orifice of the receptacle.

4. The timer of claim 3 wherein the ring has inwardly protruding sides which taper towards each other to define the aperture.

5. The timer of claim 4 wherein the ring has a triangularly-shaped cross-section.

6. The timer of claim 1 wherein the receptacle is mounted to and spaced from the interior wall section of the container by at least one support having a diamond-shaped cross-section with a point of the support directed towards the base end of the chamber.

7. The timer of claim 6 wherein the support has a triangularly-shaped cross-section with an apex of the support directed towards the base end of the chamber.

8. The timer of claim 1 wherein at least a portion of the container is made from a substantially transparent material.

9. The timer of claim 8 wherein the receptacle is made from a substantially transparent material.

10. A quickly resettable timer which comprises:

an elongated, circular cylinder having a uniform diameter and defining a chamber having a base end and a reset end opposite the base end;

a quantity of a flowing, solid particulate medium contained within the chamber;

a funnel-like receptacle having a loading orifice with a uniform diameter nearest the reset end and a metered orifice opposite the loading orifice for restricting the flow of the particulate medium through the receptacle, said receptacle being mounted to and spaced from the interior of the container intermediate the base end and the reset end such that the particulate medium in the base end flows over and around the receptacle and into the reset end upon inversion of the container by rotation in any direction; and a substantially continuous ring having an outer periphery that fits snugly against the interior of the container intermediate the receptacle and the reset end of the chamber, said ring having an aperture positioned above and sized smaller than the diameter of the loading orifice of the receptacle.

11. The timer of claim 10 wherein the ring has inwardly protruding sides which taper towards each other to define the aperture.

12. The timer of claim 11 wherein the ring has a triangularly-shaped cross-section.

13. The timer of claim 10 wherein the receptacle is mounted to and spaced from the interior of the container by at least one support having a diamond-shaped cross-section with a point of the support directed towards the base end of the chamber.

14. The timer of claim 13 wherein the support has a triangularly-shaped cross-section with an apex of the support directed towards the base end of the chamber.

15. The timer of claim 10 wherein at least a portion of the container and the receptacle are made from a substantially transparent material.

* * * * *